US011293417B2

(12) United States Patent
Ono et al.

(10) Patent No.: US 11,293,417 B2
(45) Date of Patent: Apr. 5, 2022

(54) HYDRAULIC PUMP AND MOTOR

(71) Applicant: KOMATSU LTD., Tokyo (JP)

(72) Inventors: Mutsumi Ono, Tokyo (JP); Mitsuru Ohshiro, Tokyo (JP); Naoya Sodeyama, Tokyo (JP); Jun Nabata, Tokyo (JP); Shuuji Hori, Tokyo (JP)

(73) Assignee: Komatsu Ltd., Tokyo (JP)

( * ) Notice: Subject to any disclaimer, the term of this patent is extended or adjusted under 35 U.S.C. 154(b) by 172 days.

(21) Appl. No.: 16/484,921

(22) PCT Filed: Jun. 4, 2018

(86) PCT No.: PCT/JP2018/021308

§ 371 (c)(1),
(2) Date: Aug. 9, 2019

(87) PCT Pub. No.: WO2018/235573

PCT Pub. Date: Dec. 27, 2018

(65) Prior Publication Data

US 2020/0003191 A1 Jan. 2, 2020

(30) Foreign Application Priority Data

Jun. 22, 2017 (JP) ..... JP2017-122348

(51) Int. Cl.
*F04B 1/324* (2020.01)
*F04B 1/2078* (2020.01)

(52) U.S. Cl.
CPC ..... *F04B 1/324* (2013.01); *F04B 1/2078* (2013.01); *F04B 2201/1205* (2013.01); *F15B 2211/6333* (2013.01)

(58) Field of Classification Search
CPC ..... F04B 1/324; F04B 1/146; F04B 1/2078; F04B 2201/125; F04B 2201/12051;
(Continued)

(56) References Cited

U.S. PATENT DOCUMENTS 3,554,671 A * 1/1971 Schlinke ..... F04B 1/324 417/222.1
4,496,289 A * 1/1985 Heiser ..... F04B 1/324 417/217

(Continued)

FOREIGN PATENT DOCUMENTS

CN 101372941 2/2009
CN 102893027 1/2013

(Continued)

OTHER PUBLICATIONS

International Preliminary Report on Patentability in International Appln. No. PCT/JP2018/021308, dated Dec. 24, 2019, 5 pages, English translation.

(Continued)

*Primary Examiner* — Devon C Kramer
*Assistant Examiner* — Joseph S. Herrmann
(74) *Attorney, Agent, or Firm* — Fish & Richardson P.C.

(57) ABSTRACT

A variable displacement hydraulic pump or motor includes: a swash plate; a lever supported by a housing and configured to rotate in conjunction of tilting of the swash plate; and a sensor configured to detect a displacement amount of the lever.

5 Claims, 8 Drawing Sheets

(58) Field of Classification Search
CPC ..... F04B 2201/1205; F15B 2211/6333; F15B 15/2815; G01D 5/02; G01D 5/04
See application file for complete search history.

(56) References Cited

U.S. PATENT DOCUMENTS

| | | | | |
|---|---|---|---|---|
| 5,273,403 | A * | 12/1993 | Im | F04B 1/324 417/213 |
| 5,297,941 | A * | 3/1994 | Park | F04B 1/324 417/218 |
| 7,469,534 | B2 * | 12/2008 | Nishi | F16H 61/423 60/428 |
| 7,814,823 | B2 | 10/2010 | Takahashi et al. | |
| 9,410,540 | B2 | 8/2016 | Mizoguchi et al. | |
| 2011/0138799 | A1 | 6/2011 | Wagner | |
| 2014/0186196 | A1 | 7/2014 | Mizoguchi et al. | |

FOREIGN PATENT DOCUMENTS

| | | | |
|---|---|---|---|
| DE | DD247044 | A1 | 6/1987 |
| DE | 69206113 | T2 | 5/1996 |
| DE | 10063525 | A1 | 7/2002 |
| DE | 112010004755 | T5 | 3/2013 |
| EP | 0549883 | A1 | 7/1993 |
| EP | 3045723 | A1 | 7/2016 |
| JP | 52-65305 | | 5/1977 |
| JP | 04-82378 | | 7/1992 |
| JP | H07180655 | | 7/1995 |
| JP | H1137042 | A | 2/1999 |
| JP | 11-257209 | | 9/1999 |
| JP | 2002-106460 | | 4/2002 |
| JP | 4469076 | | 5/2010 |

OTHER PUBLICATIONS

Japanese Office Action in Japanese Application No. 2017-122348, dated Jan. 26, 2021, 5 pages (with English translation).
PCT International search Report in International Appln. No. PCT/JP2018/021308, dated Aug. 28, 2018, 2 pages.
Chinese Office Action in Chinese Appln. No. 201880011913.X, dated Mar. 16, 2021, 9 pages (with English translation).
German Office Action in German Appln. No. 112018003195.0, dated Feb. 8, 2022, 10 pages (with English translation).

* cited by examiner

HYDRAULIC PUMP AND MOTOR

CROSS-REFERENCE TO RELATED APPLICATIONS

This application claims priority to International Application No. PCT/JP2018/021308, filed on Jun. 4, 2018, which claims priority to Japanese Application No. 2017-122348, filed on Jun. 22, 2017, the contents of which are incorporated herein in their entirety.

TECHNICAL FIELD

The present invention relates to a hydraulic pump and a motor.

BACKGROUND ART

A hydraulic pump and a hydraulic motor have been widely used in, for instance, a construction machine and a working vehicle. The hydraulic pump is actuated to be rotated by a motor, an engine and the like, thereby discharging hydraulic oil to a hydraulic circuit. In contrast, the hydraulic motor converts a pressure of the hydraulic oil supplied from the hydraulic circuit into rotational movement. Among such hydraulic pump and motor, variable displacement hydraulic pump and motor with a swash plate have been known.

For instance, Patent Literature 1 discloses a variable displacement pump with a swash plate, in which a control valve is disposed in parallel to a working direction of a servo piston configured to tilt the swash plate, and a single lever is disposed on a common plane including working axial lines of the servo piston and the control valve, whereby the servo piston and the control valve are operable in conjunction with each other. This technique allows a product (horsepower) of a pump discharge rate and a pump discharge pressure to be controlled to a constant level by a compact and simple structure of the pump.

In the variable displacement pump, there has also been known a technique of detecting a tilt angle of the swash plate for determining the pump discharge rate, and controlling the variable displacement pump using the detected tilt angle. For instance, Patent Literature 2 discloses a variable displacement pump including a swash plate and a potentiometer disposed on an exterior of a housing, in which a rotation transmission mechanism transmits rotation of the swash plate disposed inside the housing to the potentiometer. According to this technique, the tilt angle of the swash plate can be detected at a high accuracy using the potentiometer and the potentiometer can be easily adjusted.

CITATION LIST

Patent Literature(s)

Patent Literature 1: JP2002-106460 A
Patent Literature 2: JP11-257209 A

SUMMARY OF THE INVENTION

Problems to be Solved by the Invention

However, when the rotation of the swash plate is directly transmitted to the detector as described in Patent Literature 2, it is necessary to concentrically arrange the transmission mechanism and a tilt axis of the swash plate, which restricts a design of the pump. This also applies to the variable displacement motor with the swash plate.

In light of the above, an object of the invention is to provide a variable displacement hydraulic pump and a variable displacement hydraulic motor each being provided with a swash plate and capable of detecting a tilt angle of the swash plate and reducing restriction on designs.

Means for Solving the Problems

According to an aspect of the invention, variable displacement hydraulic pump or motor includes: a swash plate; a lever supported by a housing and configured to rotate in conjunction of tilting of the swash plate; and a sensor configured to detect a displacement amount of the lever.

According to the above aspect of the invention, the displacement generated by tilting the swash plate is converted into the rotation of the lever in contact with the swash plate. Accordingly, the influence of micro-vibration of the swash plate is reducible and the tilt angle is detectable at a high accuracy. In addition, since it is not necessary to dispose the lever concentrically with the tilt axis of the swash plate, restriction on a device design is reducible.

DESCRIPTION OF EMBODIMENT(S)

1. Overall Arrangement of Work Machine

Figure 1:
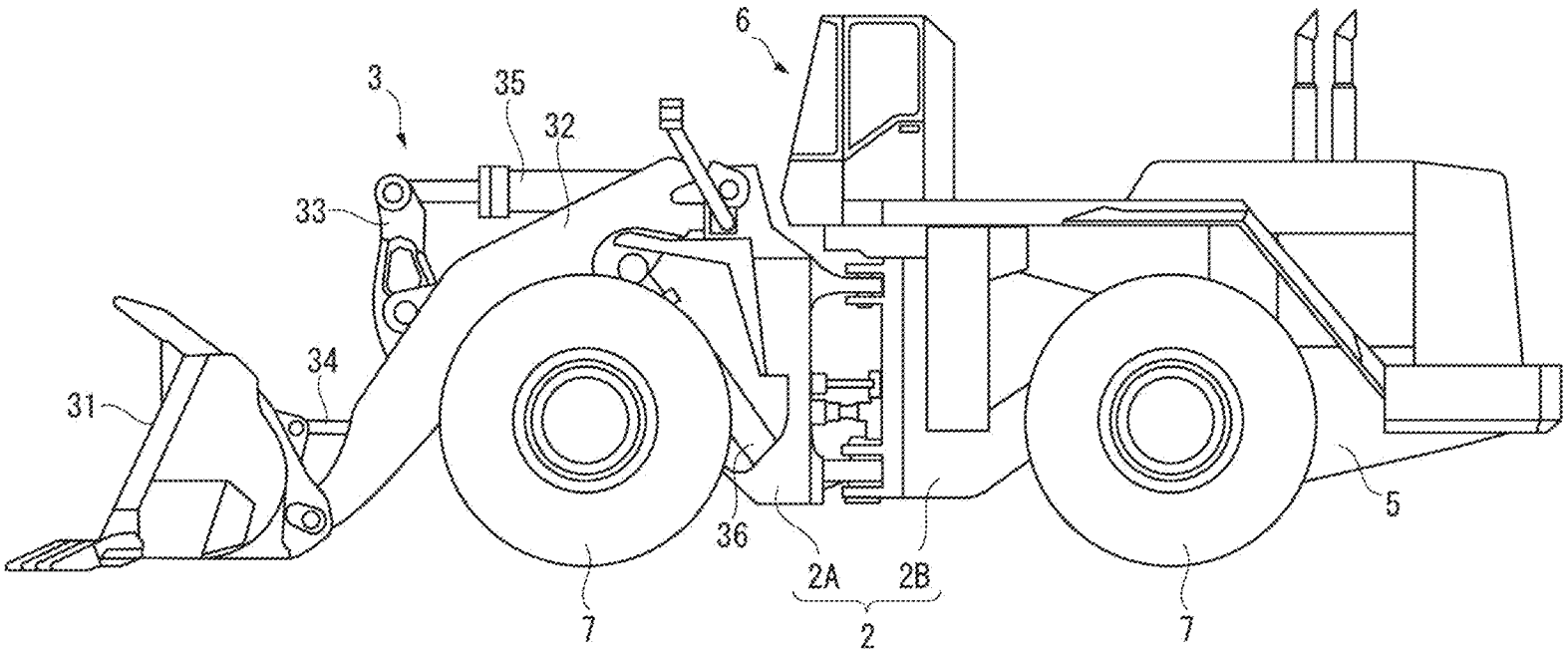
FIG. 1 is a side view of a work machine according to an exemplary embodiment of the invention.

FIG. 1 shows a wheel loader 1 as an example of a work machine according to an exemplary embodiment of the invention. The wheel loader 1 includes a vehicle body 2 formed by a front vehicle body 2A and a rear vehicle body 2B. Working equipment 3, which is hydraulically drivable, is attached to a front side (on the left side of the figure) of the front vehicle body 2A. The working equipment 3 includes a bucket 31 for digging and loading, a boom 32, a bell crank 33, a connecting link 34, a bucket cylinder 35, a boom cylinder 36 and the like. The rear vehicle body 2B includes a rear vehicle body frame 5. A box-shaped cab 6 accessible by an operator gets is provided to a front side of the rear vehicle body frame 5. An engine and a hydraulic pump (which are not shown) are housed in a rear side of the rear vehicle body frame 5.

In the above-described wheel loader 1, an output from the engine is distributed into a travelling system for driving tires 7 and a hydraulic system for driving the working equipment 3. In the hydraulic system, the hydraulic pump is driven by the output from the engine to supply a pressure oil to the working equipment 3 through a hydraulic circuit. A bucket cylinder 35 and a boom cylinder 36 are extended and contracted using the pressure oil, thereby moving the bucket 31 between a loading position and a tilt position and vertically moving the boom 32.

2. Structure of Hydraulic Pump

Figure 2:
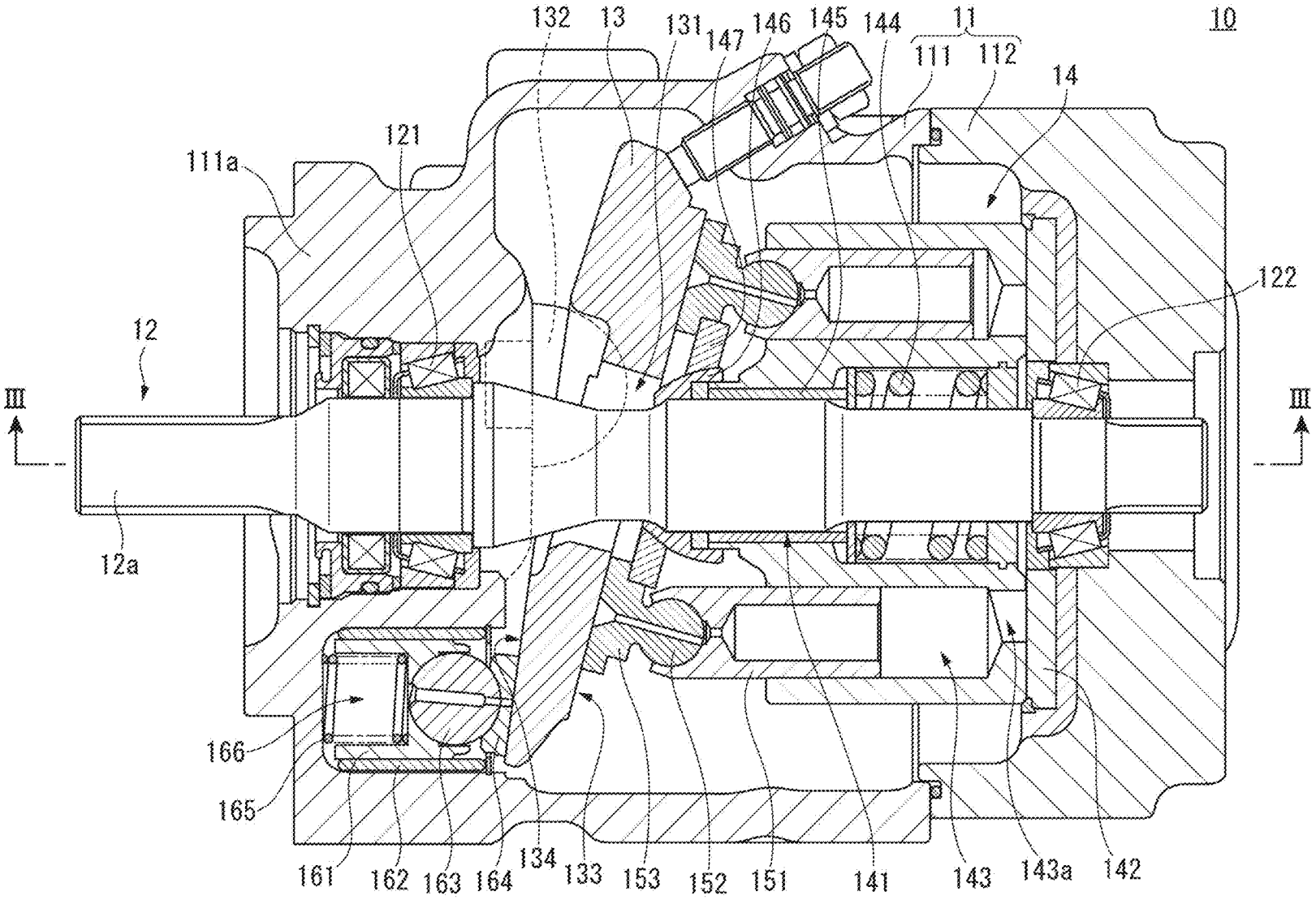
FIG. 2 is a cross sectional view showing a structure of a hydraulic pump according to a first exemplary embodiment of the invention.
Figure 3:
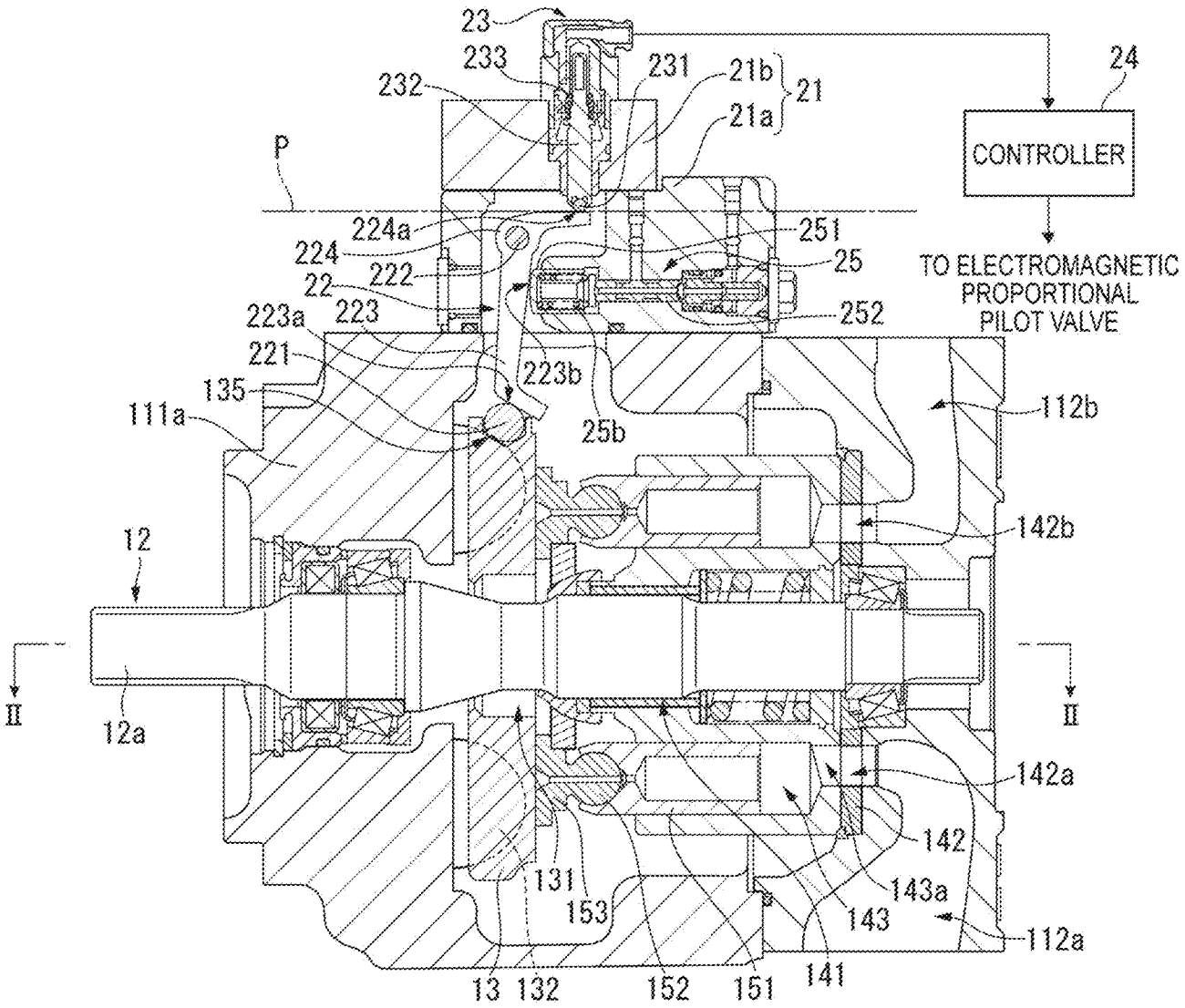
FIG. 3 is another cross sectional view showing the structure of the hydraulic pump according to the first exemplary embodiment of the invention.

FIGS. 2 and 3 show a hydraulic pump 10 according to a first exemplary embodiment of the invention. FIG. 3 is a cross sectional view of the hydraulic pump 10 taken along a III-III line in FIG. 2. FIG. 2 is a cross sectional view of the hydraulic pump 10 taken along a II-II line in FIG. 3. The hydraulic pump 10 includes a housing 11 and a rotary shaft 12. The housing 11 includes a housing body 111 and a housing cap 112 that are fastened with a bolt (not shown). The rotary shaft 12 penetrating an inner space of the housing 11 is rotatably supported by the housing body 111 through a bearing 121 while being rotatably supported by the housing cap 112 through a bearing 122. One end of the rotary shaft 12 defines a drive end 12*a* drivable by the output from the engine and projects outward from a base end wall 111*a* of the housing body 111. A swash plate 13 and a cylinder block 14 are disposed to an outer circumference of the rotary shaft 12 in the inner space of the housing 11.

The swash plate 13 is a plate member having a through hole 131 at the center. The swash plate 13, while the rotary shaft 12 is placed in the through hole 131, is attached to the base end wall 111*a* of the housing body 111 through a pair of ball retainers (supports) 132. The swash plate 13 can be tilted relative to the housing 11 and the rotary shaft 12 with the ball retainers 132 serving as a fulcrum. The swash plate 13 has, on both sides, a first slide surface 133 facing the housing cap 112 and a second slide surface 134 facing the housing body 111. The first slide surface 133 is a flat surface to contact with a later-described piston shoe and is annularly formed around the through hole 131. The second slide surface 134 is a flat surface to contact with a later-described servo piston shoe and is formed at a part of the swash plate 13 facing the servo piston shoe.

The cylinder block 14 is a cylindrical member having at the center a through hole 141 for the rotary shaft 12. The cylinder block 14, which is coupled to the rotary shaft 12 by a spline formed on the through hole 141, rotates in conjunction with the rotary shaft 12. An end of the cylinder block 14 near the housing cap 112 is in contact with an inner wall of the housing cap 112 through a valve plate 142. The valve plate 142, which is a plate member having a suction port 142*a* and a discharge port 142*b*, is fixed to the housing cap 112. The suction port 142*a* of the valve plate 142 communicates with a suction passage 112*a* formed in the housing cap 112. The discharge port 142*b* communicates with a discharge passage 112*b* formed in the housing cap 112.

Moreover, the cylinder block 14 includes a plurality of cylinders 143 formed therein. The cylinders 143 are annularly arranged around the rotary shaft 12. Each of the cylinders 143 has a communication port 143*a* penetrating a side near the valve plate 142 to reach an end surface of the cylinder block 14 near the valve plate 142. While the cylinder block 14 rotates in conjunction with the rotary shaft 12, the valve plate 142 is fixed to the housing cap 112. Accordingly, the communication port 143*a* of each of the cylinders 143 is to alternately communicate with the suction port 142*a* and the discharge port 142*b*.

Meanwhile, a piston 151 is inserted from a side near the swash plate 13 in each of the cylinders 143 and is slidably received therein. A piston shoe 153 is coupled through a ball joint 152 to a side of the piston 151 near the swash plate 13. A press force of a press spring 144 whose one end is fixed to the cylinder block 14 is transmitted through a rod 145, a retainer guide 146, and a press plate 147 to the piston shoe 153, whereby the piston shoe 153 is brought into contact with the first slide surface 133 of the swash plate 13. With this operation, when the cylinder block 14 rotates in conjunction with the rotary shaft 12, a position of the piston 151 relative to the corresponding one of the cylinders 143 changes along the tilted swash plate 13, whereby oil is discharged from the hydraulic pump 10. Specifically, the piston 151 is drawn from the corresponding cylinder 143 while the corresponding cylinder 143 is in communication with the suction passage 112*a*, and the piston 151 is pushed into the corresponding cylinder 143 while the corresponding cylinder 143 is in communication with the discharge passage 112*b*. Accordingly, the oil sucked from the suction passage 112*a* is delivered to the discharge passage 112*b*.

A discharge rate of the oil in the above-described hydraulic pump 10 is determined in accordance with a tilt angle of the swash plate 13. At the larger tilt angle, a stroke of the piston 151 relative to each of the cylinders 143 becomes large, thereby increasing the discharge rate of the oil. On the other hand, at the smaller tilt angle, the stroke of the piston 151 relative to each of the cylinders 143 becomes small, thereby decreasing the discharge rate of the oil. It should be noted that, when the tilt angle is zero and the swash plate 13 is perpendicular to the rotary shaft 12, the stroke of the piston 151 becomes zero, whereby no oil is discharged.

The tilt angle of the swash plate 13 is adjusted by operating a servo piston 161 shown in FIG. 2. The servo piston 161 is slidably supported inside a servo sleeve 162 fixed to the housing body 111. One end of the servo piston 161 is coupled to a servo piston shoe 164 through a ball joint 163. A press force of a spring 165 interposed between the housing body 111 and the servo piston 161 is transmitted through the servo piston 161 and the ball joint 163 to the servo piston shoe 164, whereby the servo piston shoe 164 is brought into contact with the second slide surface 134 of the swash plate 13. Accordingly, as described later, the tilt angle of the swash plate 13 can be adjusted by controlling a pressure of the oil supplied to a pressurized chamber 166 of the servo piston 161.

3. Structure of Tilt State Detector

FIG. 3 shows a tilt state detector provided to the hydraulic pump 10. Herein, the tilt state refers to an angle, a position, a posture and the like. The tilt state detector includes: a lever 22 and a stroke sensor 23 that are supported by the housing 21; and a controller 24. The housing 21 includes a servo valve housing 21*a* and a stroke sensor housing 21*b*. The lever 22 is in indirect contact with the swash plate 13 through a ball 221. The ball 221 is fitted in a recess 135 formed at an end of the swash plate 13 and is moved in accordance with the displacement generated on the end of the swash plate 13 caused by a tilt of the swash plate 13. The lever 22 is rotatably supported around the rotary shaft 222 and is in contact with the ball 221 by biasing force of springs of the stroke sensor 23 and the servo valve 25. The controller 24 includes a calculator configured to calculate the tilt angle of the swash plate 13 on a basis of an output signal of the stroke sensor 23.

In the exemplary embodiment, the lever 22 has a first arm 223 and a second arm 224. As shown in the figure, the first arm 223 extends downward from the rotary shaft 222 in the figure. Specifically, the first arm 223 extends from a hollow portion of the servo valve housing 21*a* to a hollow portion of the housing body 111 of the hydraulic pump 10, so that a contact point 223*a* provided at an end of the first arm 223 is brought into contact with the ball 221. In an intermediate portion of the first arm 223, a servo valve 25 is in contact with a servo valve contact portion 223*b*. The servo valve 25 has a spring box 251 configured to press the servo valve 25 onto the servo valve contact portion 223*b* with a spring 25*b*. The second arm 224 extends from the rotary shaft 222 rightward in the figure, in other words, in a direction different from the first arm 223. A measurement portion 224*a* of the second arm 224 is in contact with a contact piece 231 of the stroke sensor 23. In the exemplary embodiment, the lever 22 is disposed on a first plane perpendicular to the rotary shaft 222 (i.e., a plane in parallel to a plane of paper in FIG. 3) and has the measurement portion 224*a* disposed on a second plane (i.e., a plane P shown in FIG. 3) perpendicular to the first plane.

Herein, in the example shown in the figure, the contact piece 231 and the spring box 251 are attached in such a direction as to generate moment in the same direction around the rotary shaft 222 of the lever 22. Specifically, the contact piece 231 and the spring box 251 are attached so as to generate moment clockwise in the figure around the rotary shaft 222.

The stroke sensor 23, which is exemplified by a contact stroke sensor, generates an output signal in accordance with a displacement of the contact piece 231 in a direction along the shaft 232. The stroke sensor 23 has a spring 233 for pressing the contact piece 231 onto the measurement portion 224*a* of the lever 22. At this time, since the contact piece 231 in contact with the second arm 224 of the lever 22 is displaced by the lever 22 rotating around the rotary shaft 222, it can be said that the stroke sensor 23 also detects a displacement amount, specifically, a rotation amount of the lever 22.

4. Structure of Servo Mechanism

Figure 4:
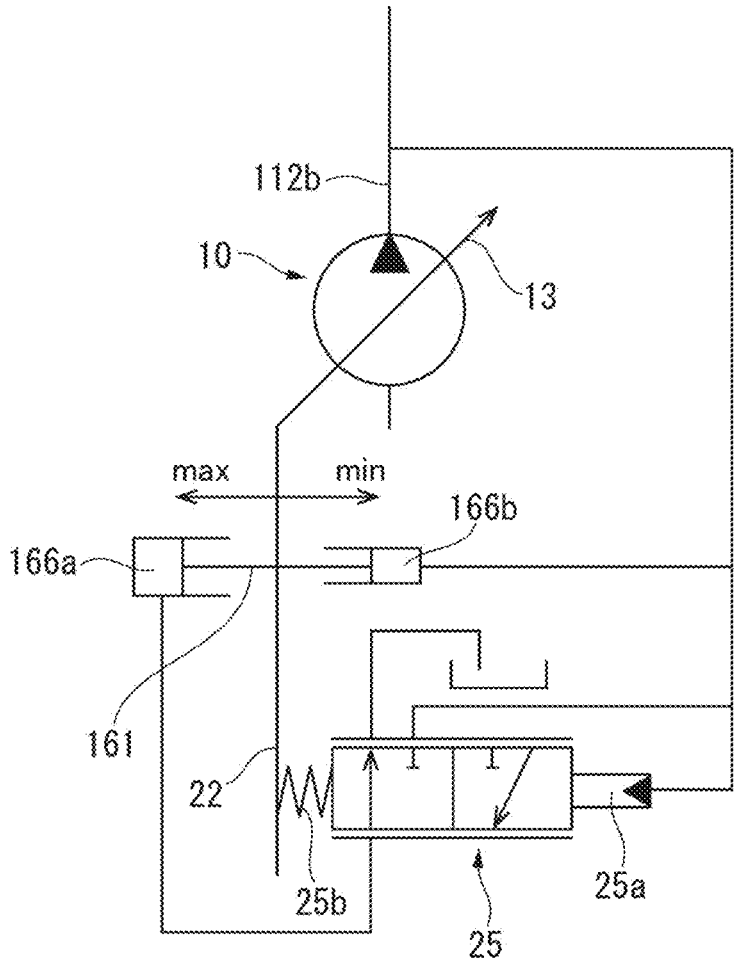
FIG. 4 is a hydraulic circuit diagram showing a servo mechanism of the hydraulic pump shown in FIGS. 2 and 3.

FIG. 4 is a hydraulic circuit diagram showing a servo mechanism of the hydraulic pump 10 shown in FIGS. 2 and 3. It should be noted that components other than the servo mechanism are omitted in in FIG. 4. Referring to FIG. 4, the pressurized chamber 166 of the servo piston 161 includes a large-diameter pressurized chamber 166*a* and a small-diameter pressurized chamber 166*b*. The large-diameter pressurized chamber 166*a* is connected to the discharge passage 112*b* of the hydraulic pump 10 through the servo valve 25. On the other hand, the small-diameter pressurized chamber 166*b* is connected to the discharge passage 112*b* without passing through the servo valve 25.

Herein, in the servo valve 25 that is a three-port two-position directional control valve, a spool 252 is switched between a communication position and a drain position depending on a balance between a pressure of an oil supplied from the discharge passage 112*b* of the hydraulic pump 10 to the hydraulic pilot 25*a* and a biasing force of the spring 25*b* in contact with the lever 22 through the spring box 251. At the communication position, the large-diameter pressurized chamber 166*a* of the servo piston 161 communicates with the discharge passage 112*b*. At the drain position, the large-diameter pressurized chamber 166*a* is blocked out of the discharge passage 112*b* and communicates with a tank.

For instance, when the servo valve 25 is at the communication position, the oil is supplied to the large-diameter pressurized chamber 166*a*, so that the servo piston 161 moves in such a direction as to reduce the tilt angle of the swash plate 13. As the tilt angle is reduced, the lever 22 rotates rightward in FIG. 4, specifically, in such a direction as to compress the spring 25*b*. As a result, a biasing force of the spring 25*b* is increased to switch the servo valve 25 to the drain position. At the drain position, since the oil is discharged from the large-diameter pressurized chamber 166*a* while the oil continues to be supplied to the small-diameter pressurized chamber 166*b*, the servo piston 161 moves in such a direction as to increase the tilt angle of the swash plate 13. As the tilt angle is increased, the lever 22 rotates leftward in FIG. 4, specifically, in such a direction as to extend the spring 25*b*. As a result, the biasing force of the spring 25*b* is decreased to again switch the servo valve 25 to the communication position. By repeating the above-described feed-back operation of the servo valve with respect to the position of the swash plate 13, the tilt angle is maintained substantially constant when the hydraulic pump 10 has a constant discharge pressure.

Herein, when the discharge pressure of the hydraulic pump 10 is increased by an increase in a load pressure in the working equipment 3, the servo valve 25 is not switched to the drain position unless the lever 22 compresses the spring 25*b* by a large amount. Accordingly, in this case, the tilt angle is maintained smaller than before the discharge pressure is increased. On the other hand, when the discharge pressure of the hydraulic pump 10 is decreased, the servo valve 25 is switched to the drain position with the lever 22 compressing the spring 25*b* only by a small amount. Accordingly, in this case, the tilt angle is maintained larger than before the discharge pressure is decreased. The servo valve 25 and the servo piston 161 thus maintain a constant product (horsepower) of the discharge rate from the hydraulic pump 10 determined by the tilt angle of the swash plate 13 and the discharge pressure from the hydraulic pump 10 determined by the load pressure.

Although not shown in FIG. 4, the pressurized chamber 166 of the servo piston 161 further includes an additional pressurized chamber as well as the large-diameter pressurized chamber 166*a* and the small-diameter pressurized chamber 166*b*. A pressure of the oil supplied to the additional pressurized chamber is controlled by the electromagnetic proportional pilot valve. The controller 24 calculates the tilt angle of the swash plate 13 on a basis of the output signal of the stroke sensor 23 and inputs a control signal generated on a basis of the calculated tilt angle to the electromagnetic proportional pilot valve. The electromagnetic proportional pilot valve changes the pressure of the oil supplied to the additional pressurized chamber, thereby changing the tilt angle of the swash plate 13 set by the servo mechanism with respect to a certain discharge pressure of the hydraulic pump 10, so that the horsepower of the hydraulic pump 10 can be adjusted.

5. Structure of Controller

Figure 5:
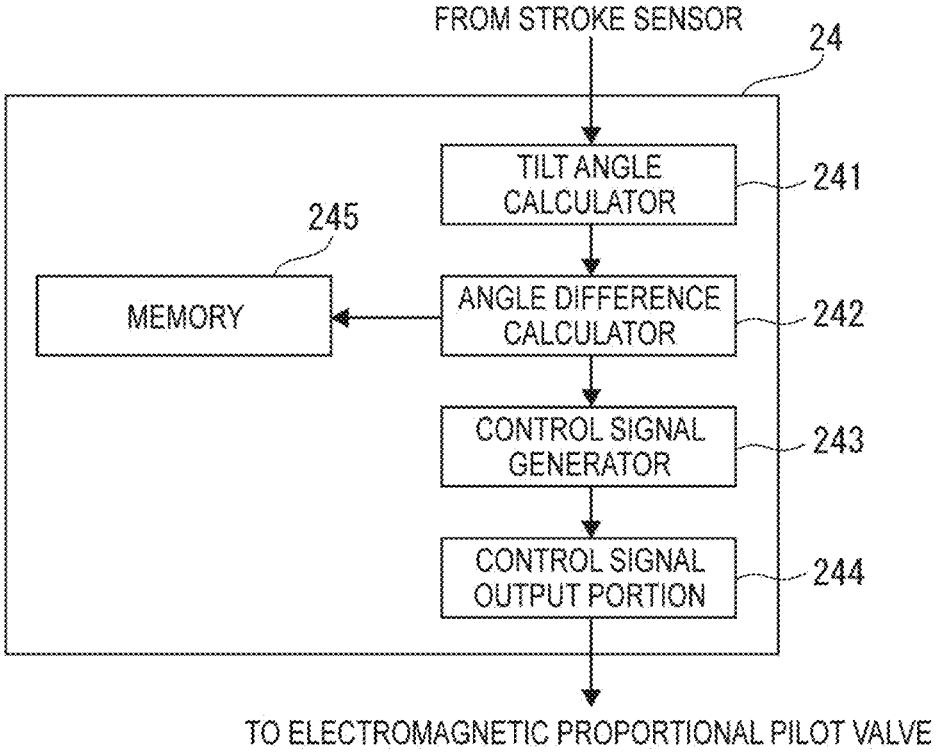
FIG. 5 is a block diagram of a controller of the hydraulic pump shown in FIGS. 2 and 3.

FIG. 5 illustrates a block diagram of the controller 24 of the hydraulic pump 10 shown in FIGS. 2 and 3. The controller 24 includes a tilt angle calculator 241, an angle difference calculator 242, a control signal generator 243, a control signal output portion 244, and a memory 245.

The tilt angle calculator 241 calculates the tilt angle of the swash plate 13 on a basis of the output signal of the stroke sensor 23. Specifically, the tilt angle calculator 241 calculates a rotation angle of the lever 22 on a basis of displacement of the contact piece 231 indicated by the output signal of the stroke sensor 23 and a distance between the measurement portion 224*a* and the rotary shaft 222. Further, the tilt angle calculator 241 calculates the tilt angle of the swash plate 13 on a basis of a distance between the contact point 223*a* and the rotary shaft 222 of the lever 22 and a relative positional relationship between the ball 221 and a tilt axis of the swash plate 13.

The angle difference calculator 242 calculates a difference between a control-target tilt angle determined based on a state of an engine driving the hydraulic pump 10 and operation amounts and the like of an operation lever, a pedal and the like disposed in the cab 6 and the like, and the tilt angle of the swash plate 13 calculated by the tilt angle calculator 241. The angle difference calculator 242 refers to data of a control pattern and the like stored in the memory 245 in order to determine the control-target tilt angle.

The control signal generator 243 generates a control signal on a basis of the angle difference calculated by the angle difference calculator 242. The control signal output portion 244 converts the control signal generated by the control signal generator 243 into a current value and a voltage value and outputs the current value and the voltage value to the electromagnetic proportional pilot valve annexed to the servo piston 161.

In the exemplary embodiment with the above arrangement, the displacement of the end of the swash plate 13 caused by the tilting of the swash plate 13 is converted into the rotation of the lever 22 in contact with the swash plate 13 through the ball 221, and the tilt angle of the swash plate 13 is calculated based on the rotation amount of the lever 22. Since the displacement of the swash plate 13 by the tilting occurs at any portion of the swash plate 13 except for the tilt axis, the displacement of the swash plate 13 can be detected when the lever 22 is in contact with any portion of the swash plate 13 in place of the above-exemplified end of the swash plate 13.

Herein, for instance, the tilt angle of the swash plate 13 can also be detected by contacting the contact piece 231 of the stroke sensor 23 with swash plate 13 without using the lever 22. However, at this time, it is not easy to detect the tilt angle of the swash plate 13 at a high accuracy due to micro-vibration generated by the rotation of the cylinder block 14 in contact with the swash plate 13. In the exemplary embodiment, the influence of the micro-vibration is reduced by contacting the contact piece 231 of the stroke sensor 23 to the lever 22 that is a member independent of the swash plate 13, thereby enabling a highly accurate detection of the tilt angle.

Moreover, even when the generated rotation amount of the lever 22 is the same, the displacement of the contact piece 231 is different depending on the distance between the rotary shaft 222 and a contact position of the contact piece 231 with the lever 22. Specifically, as the contact position of the contact piece 231 is closer to the rotary shaft 222, the displacement is smaller. As the contact position of the contact piece 231 is remote from the rotary shaft 222, the displacement is larger. By using the above, a resolution of the detection value of the stroke sensor 23 can be changed by adjusting the contact position of the contact piece 231 with the lever 22.

6. Other Exemplary Embodiments

Figure 6A:
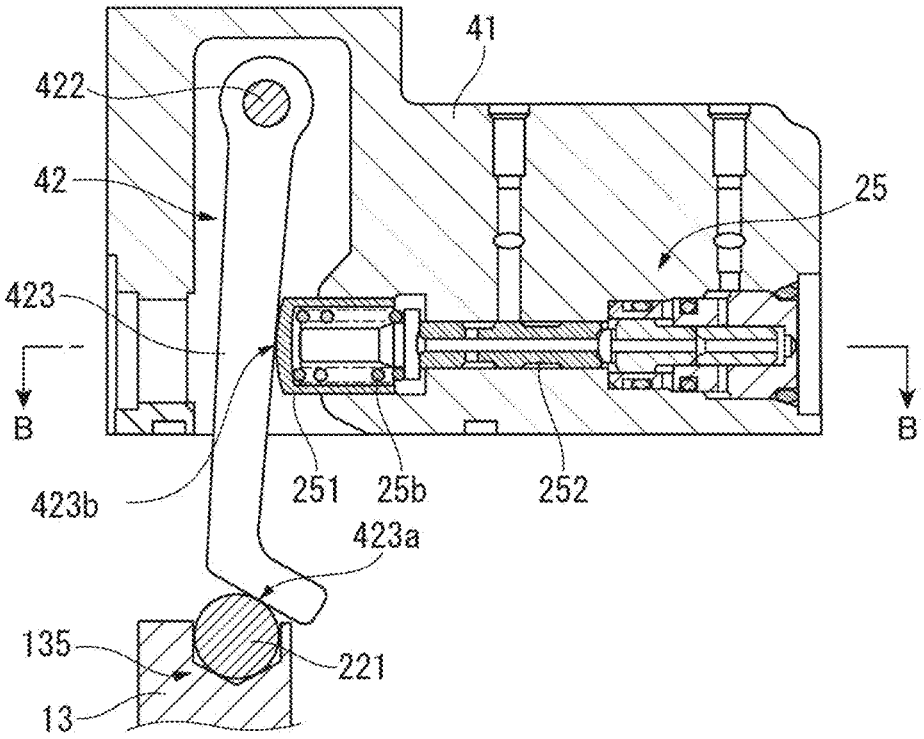
FIG. 6A is a cross sectional view showing a structure of a tilt state detector of a hydraulic pump according to a second exemplary embodiment of the invention.
Figure 6B:
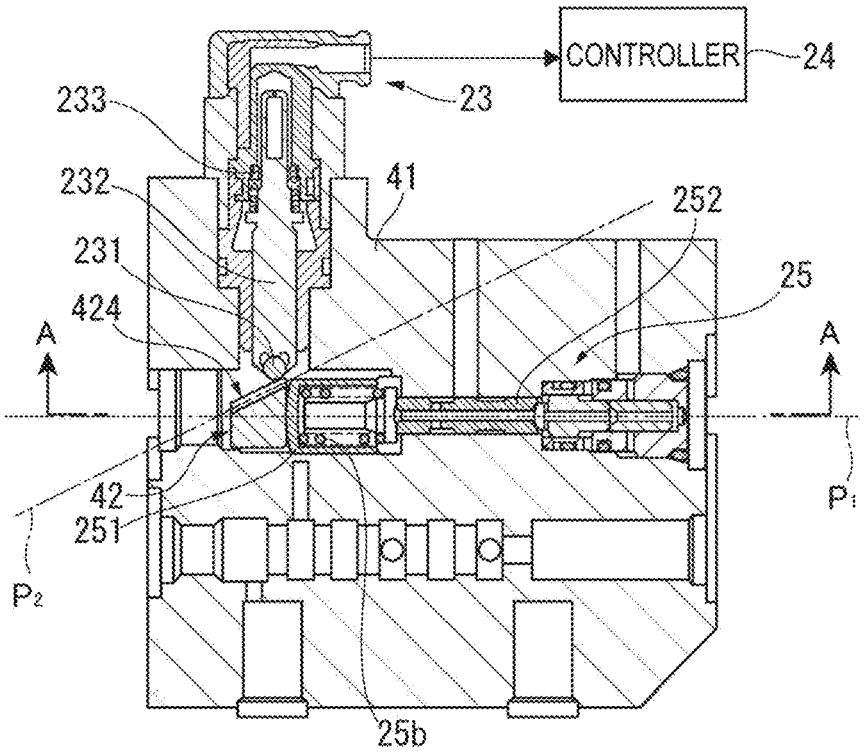
FIG. 6B is another cross sectional view showing the structure of the tilt state detector of the hydraulic pump according to the second exemplary embodiment of the invention.

FIGS. 6A and 6B show a tilt state detector of a hydraulic pump according to a second exemplary embodiment of the invention. FIG. 6B is a cross sectional view taken along a B-B line in FIG. 6A. FIG. 6A is a cross sectional view taken along an A-A line in FIG. 6B. In an illustrated example, the tilt state detector includes: a lever 42 and the stroke sensor 23 received in a housing 41; and the controller 24. The lever 42 is in contact with the swash plate 13 through the ball 221. The lever 42, which is disposed on a first plane $P_1$ perpendicular to a rotary shaft 422, is rotatably supported around the rotary shaft 422 and is in contact with the ball 221 by biasing force of springs of the stroke sensor 23 and the servo valve 25.

In the illustrated example, the lever 42 has a single arm 423. The arm 423 extends downward from the rotary shaft 422 in FIG. 6A. Specifically, the arm 423 extends from a hollow portion of the housing 41 to a hollow portion of a housing of the hydraulic pump to be in contact with the ball 221 at a contact point 423*a* provided at an end of the arm 423. In addition, particularly as shown in FIG. 6B, the arm 423 of the lever 42 has an inclined surface 424 angularly formed with respect to the first plane $P_1$. The contact piece 231 of the stroke sensor 23 is in contact with the inclined surface 424 in a direction intersecting the first plane $P_1$. Also in this case, the inclination of the inclined surface 424 causes the displacement of the contact piece 231 in accordance with the rotation amount of the lever 42. The inclined surface 424 is an example of the measurement portion to be measured by the stroke sensor 23. In other words, in the exemplary embodiment, the lever 42 has the measurement portion on a second plane $P_2$ diagonally intersecting the first plane $P_1$ perpendicular to the rotary shaft 422.

By contacting the contact piece 231 with the inclined surface 424 as described above, for instance, the contact piece 231 and the spring box 251 of the servo valve 25 in contact with a servo valve contact portion 423*b* of the lever 42 can contact with the arm 423 in different directions at longitudinally close positions. With this arrangement, the tilt state detector can be more compact in size. Since the second exemplary embodiment has the same structures as those in the first exemplary embodiment except for the above structures, overlapping descriptions of the same structures will be omitted.

Figure 7:
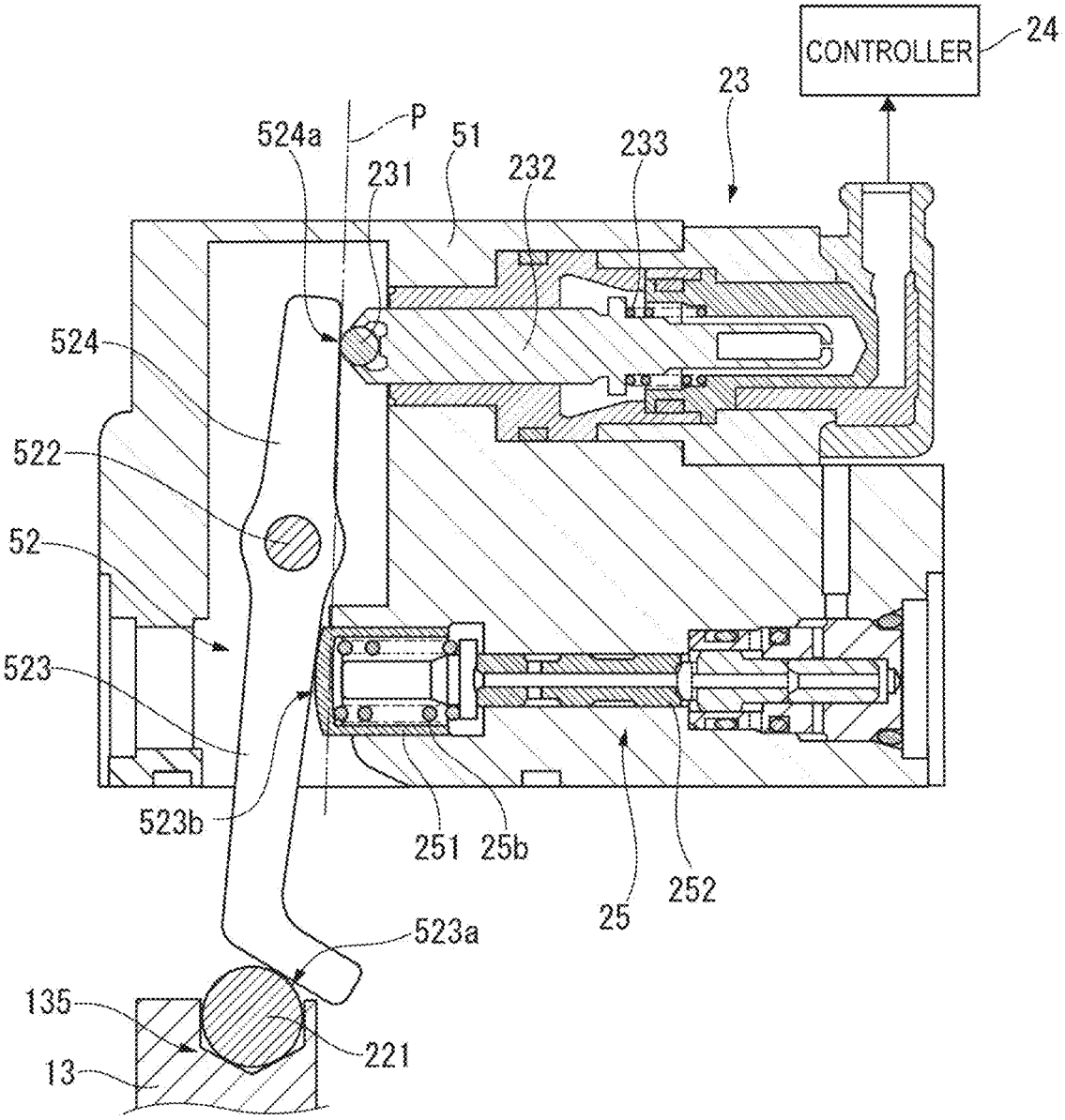
FIG. 7 is a cross sectional view showing a structure of a tilt state detector of a hydraulic pump according to a third exemplary embodiment of the invention.

FIG. 7 shows a tilt state detector of a hydraulic pump according to a third exemplary embodiment of the invention. In an illustrated example, the tilt state detector includes: a lever 52 and the stroke sensor 23 received in a housing 51; and the controller 24. The lever 52 is in contact with the swash plate 13 through the ball 221. The lever 52 is rotatably supported around a rotary shaft 522 and is in contact with the ball 221 by a biasing force of the spring of the servo valve 25.

In the illustrated example, the lever 52 has a first arm 523 and a second arm 524. The arm 523 extends downward from the rotary shaft 522 in FIG. 7. Specifically, the arm 523 extends from a hollow portion of the housing 51 to a hollow portion of a housing of the hydraulic pump to be in contact with the ball 221 at a contact point 523*a* provided at an end of the arm 523. The spring box 251 of the servo valve 25 is in contact with a servo valve contact portion 523*b* of the first arm 523. On the other hand, the second arm 524 extends upward from the rotary shaft 522 in FIG. 7 The contact piece 231 of the stroke sensor 23 is in contact with a measurement portion 524*a* of the second arm 524. In the exemplary embodiment, the lever 52 is disposed on a first plane (i.e., a plane in parallel to a plane of paper in FIG. 7) perpendicular to the rotary shaft 522 and has the measurement portion 524*a* disposed on a second plane (i.e., a plane P shown in FIG. 7) perpendicular to the first plane.

In the above example, since the stroke sensor 23 is disposed in parallel to the servo valve 25, the tilt state detector can be more compact in size in a height direction in FIG. 7. Since the third exemplary embodiment has the same structures as those in the first exemplary embodiment except for the above structures, overlapping descriptions of the same structures will be omitted.

Figure 8:
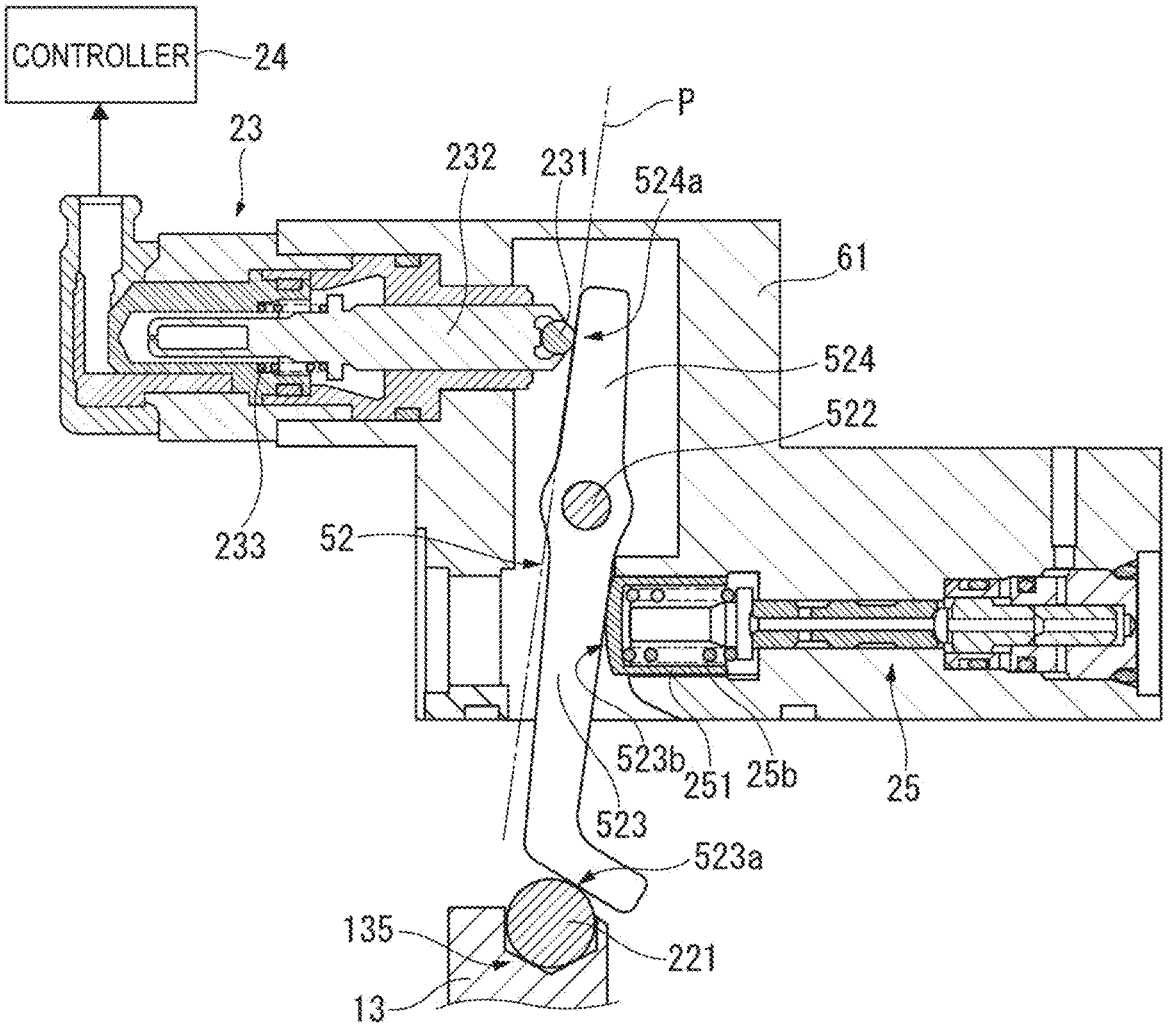
FIG. 8 is a cross sectional view showing a structure of a tilt state detector of a hydraulic pump according to a fourth exemplary embodiment of the invention.

FIG. 8 shows a tilt state detector of a hydraulic pump according to a fourth exemplary embodiment of the invention. In an illustrated example, the tilt state detector includes: the lever 52 and the stroke sensor 23 received in a housing 61; and the controller 24. The fourth exemplary embodiment is different from the third exemplary embodiment in that the stroke sensor 23 and the servo valve 25 are attached in such a direction as to generate moment in the same direction around the rotary shaft 522 of the lever 52. Also in the exemplary embodiment, the lever 52 is disposed on the first plane (i.e., a plane in parallel to a plane of paper in FIG. 8) perpendicular to the rotary shaft 522 and has the measurement portion 524*a* disposed on the second plane (i.e., the plane P shown in FIG. 8) perpendicular to the first plane. Since the fourth exemplary embodiment has the same structures as those in the third exemplary embodiment except for the above structures, overlapping descriptions of the same structures will be omitted.

As exemplarily described in the first to fourth exemplary embodiments, the stroke sensor 23 of the invention can be provided to the hydraulic pump 10 in various directions and various postures. Accordingly, for instance, the arrangement of the stroke sensor 23 can be changed suitably for a shape of a usable space around the hydraulic pump 10, or, when an additional stroke sensor 23 is attached to the existing hydraulic pump 10, a direction or a posture of the additional stroke sensor 23 for an easy attachment can be selected.

The invention is not limited to the above-described embodiments, but includes modifications and improvements as long as an object of the invention can be achieved.

Although the hydraulic pump is exemplified in the above exemplary embodiments, for instance, in some embodiments, a tilt angle of a swash plate is detected in the same manner in a variable displacement hydraulic motor with the swash plate. Alternatively, in some embodiments, a tilt angle of a bent axis is detected in the same manner in a bent axis variable displacement hydraulic pump or hydraulic motor. A working fluid of the hydraulic pump or motor is not limited to oil but other kinds of fluids are usable.

In the above exemplary embodiments, the lever is in indirect contact with the swash plate through the ball. However, for instance, in some embodiments, the lever is in direct contact with the swash plate without using the ball. Moreover, for instance, in some embodiments, the lever is in indirect contact with the swash plate through a single member or a plurality of members other than the ball.

In the above exemplary embodiments, the stroke sensor, which is a contact displacement gauge, is used for detecting the rotation amount of the lever. However, for instance, in some embodiments, a non-contact displacement gauge is used for detecting the rotation amount of the lever. Alternatively, for instance, in some embodiments, a rotary encoder disposed near the rotary shaft of the lever is used for detecting the rotation amount of the lever on a basis of the rotation angle.

In the above exemplary embodiments, the servo piston, which is driven by the hydraulic pressure, is used for changing the tilt angle of the swash plate. However, for instance, in some embodiments, a non-hydraulic driving unit is used for changing the tilt angle of the swash plate. Specifically, for instance, in some embodiments, the servo piston is replaced by a proportional solenoid valve. In this case, the servo valve is unnecessary and the control signal generated in the controller is inputted to the proportional solenoid valve.

In the above exemplary embodiments, the hydraulic pump for driving the working equipment of the wheel loader is exemplarily described. However, for instance, a fluid pressure rotary device in some embodiments is applicable to other work machines such as a hydraulic excavator, bulldozer and forklift.

The invention claimed is:

1. A variable displacement hydraulic pump or motor, comprising:

a swash plate configured to define a swashplate axis that is tilted with respect to a rotary axis of the variable displacement hydraulic pump or motor;

a ball disposed at an end of the swash plate and configured to move in accordance with a displacement of the end of the swash plate;

wherein the lever comprises a contact point in contact with the ball, and wherein the stroke sensor, the lever, the ball, the servo valve, and the servo valve contact portion are disposed on the first plane, the first plane being perpendicular to a plane defined by the rotary axis and the swashplate axis.

2. The variable displacement hydraulic pump or motor according to claim 1, wherein the servo valve comprises a spring box configured to press the servo valve onto the servo valve contact portion of the lever using a first spring, wherein the stroke sensor comprises a contact piece and a second spring, the second spring being configured to press the contact piece onto the measurement portion of the lever, and wherein the servo valve and the stroke sensor are configured to generate a moment in the same direction around the rotary shaft of the lever.

3. The variable displacement hydraulic pump or motor according to claim 1, wherein the lever comprises the measurement portion and the servo valve contact portion on opposite sides of the rotary shaft of the lever.

4. The variable displacement hydraulic pump or motor according to claim 1, wherein the contact point of the lever is in direct contact with the ball.

5. The variable displacement hydraulic pump or motor according to claim 1, wherein the swash plate defines a recess at the end of the swash plate, the recess receiving at least a part of the ball.

* * * * *